US010232623B2

(12) United States Patent
Yildirim et al.

(10) Patent No.: US 10,232,623 B2
(45) Date of Patent: Mar. 19, 2019

(54) BUBBLER

(71) Applicants: Hewlett-Packard Development Company, L.P., Houston, TX (US); Kathleen Smektala, Camas, WA (US)

(72) Inventors: Ozgur E. Yildirim, Albany, OR (US); Volker Smektala, Camas, WA (US); Mike H. Steed, Corvallis, OR (US); Joseph R. Elliot, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/832,713

(22) Filed: Dec. 5, 2017

(65) Prior Publication Data

US 2018/0093480 A1 Apr. 5, 2018

Related U.S. Application Data

(63) Continuation of application No. 15/235,951, filed on Aug. 12, 2016, now Pat. No. 9,868,289, which is a continuation of application No. 11/924,590, filed on Oct. 25, 2007, now Pat. No. 9,452,605.

(51) Int. Cl.

| | |
|---|---|
| ***B41J 2/17*** | (2006.01) |
| ***B41J 2/055*** | (2006.01) |
| ***B41J 2/14*** | (2006.01) |

(52) U.S. Cl.

CPC ..... *B41J 2/17* (2013.01); *B41J 2/055* (2013.01); *B41J 2/1404* (2013.01)

(58) Field of Classification Search

CPC ..... B41J 2/17; B41J 2/055; B41J 2/1404

See application file for complete search history.

(56) References Cited

U.S. PATENT DOCUMENTS

| | | | | |
|---|---|---|---|---|
| 4,476,472 | A * | 10/1984 | Aiba | B41J 2/17503 347/86 |
| 4,477,026 | A | 10/1984 | Lockwood | |
| 4,658,272 | A * | 4/1987 | Toganoh | B41J 2/175 347/42 |
| 4,852,854 | A * | 8/1989 | Peng | B41J 2/01 251/129.15 |
| 4,931,811 | A | 6/1990 | Cowger et al. | |
| 4,992,802 | A | 2/1991 | Dion et al. | |
| 5,010,354 | A | 4/1991 | Cowger et al. | |
| 5,040,002 | A * | 8/1991 | Pollacek | B41J 2/175 137/526 |
| 5,153,612 | A | 10/1992 | Dunn et al. | |
| 5,269,832 | A | 12/1993 | Meijer | |
| 5,363,130 | A | 11/1994 | Cowger et al. | |
| 5,426,459 | A | 6/1995 | Kaplinsky | |

(Continued)

FOREIGN PATENT DOCUMENTS

| | | |
|---|---|---|
| EP | EP0375383 | 8/1993 |
| EP | 1260372 | 11/2002 |

(Continued)

*Primary Examiner* — Peter Radkowski

(74) *Attorney, Agent, or Firm* — HP Inc. Patent Department

(57) ABSTRACT

A cartridge may include a fluid reservoir, a print head to eject fluid from the reservoir through nozzles and bubblers. The print head may include a fluid feed slot to supply fluid from the reservoir to the nozzles. The bubblers are opposite the fluid feed slot.

20 Claims, 7 Drawing Sheets

(56) References Cited

U.S. PATENT DOCUMENTS 5,453,770 A 9/1995 Katakura et al.
5,505,339 A * 4/1996 Cowger ..... B41J 2/17506 222/105
5,545,326 A 8/1996 Petering
5,594,483 A 1/1997 Kaplinsky et al.
5,600,358 A 2/1997 Baldwin et al.
5,742,312 A 4/1998 Carlotta
5,751,300 A * 5/1998 Cowger ..... B41J 2/175 347/37
5,861,897 A * 1/1999 Ide ..... B41J 2/1752 347/19
5,886,718 A * 3/1999 Johnson ..... G01D 15/18 347/85
5,900,894 A * 5/1999 Koizumi ..... B41J 2/1404 347/65
5,933,175 A * 8/1999 Stathem ..... B41J 2/17506 347/87
5,936,650 A * 8/1999 Ouchida ..... B41J 2/175 347/89
5,969,738 A * 10/1999 Tomikawa ..... B41J 2/17523 347/86
5,975,681 A 11/1999 Ogasawara et al.
5,988,802 A * 11/1999 Pawlowski, Jr. ..... B41J 2/175 347/86
6,139,137 A 10/2000 Stathem et al.
6,139,138 A * 10/2000 Powers ..... B41J 2/17513 347/92
6,176,573 B1 * 1/2001 Barth ..... B41J 2/17513 347/92
6,186,620 B1 2/2001 Hsieh et al.
6,213,598 B1 * 4/2001 Hou ..... B41J 2/17513 347/86
6,270,211 B1 * 8/2001 Long ..... B41J 2/17503 347/92
6,299,673 B1 * 10/2001 Field ..... B41J 2/19 347/92
6,305,786 B1 * 10/2001 Plotkin ..... B41J 25/34 347/50
6,378,994 B1 4/2002 Ueda et al.
6,398,850 B1 * 6/2002 Field ..... B41J 2/19 347/92
6,431,694 B1 * 8/2002 Ross ..... B41J 2/17596 347/85
6,478,415 B2 * 11/2002 Barinaga ..... B41J 2/175 347/85
6,481,832 B2 * 11/2002 Liu ..... B41J 2/1404 347/65
6,520,612 B1 2/2003 Merz et al.
6,523,579 B1 * 2/2003 Tham ..... B41J 2/17513 141/18
6,523,945 B2 2/2003 Poweres et al.
6,557,974 B1 * 5/2003 Weber ..... B41J 2/14 347/47
6,634,741 B2 10/2003 Kataoka et al.
6,719,408 B2 4/2004 Yoshihira et al.
6,739,706 B2 5/2004 Barinaga et al.
6,752,493 B2 6/2004 Dowell et al.
6,773,097 B2 8/2004 Dowell
6,799,837 B1 * 10/2004 Chen ..... B41J 2/14153 347/56
6,938,986 B2 * 9/2005 Macler ..... B41J 2/1433 347/45
6,955,425 B2 10/2005 Childs et al.
6,984,029 B2 * 1/2006 Bellinger ..... B41J 2/17513 347/86
7,241,523 B1 7/2007 Arikara et al.
7,252,374 B2 * 8/2007 Usui ..... B41J 2/17523 347/84
2001/0055053 A1 12/2001 Kataoka et al.
2002/0047883 A1 4/2002 Hou et al.
2002/0062736 A1 * 5/2002 Field ..... B41J 2/19 95/241
2002/0067397 A1 6/2002 Powers et al.
2002/0186286 A1 12/2002 Roof et al.
2003/0043240 A1 3/2003 Dowell
2003/0142183 A1 7/2003 Mojica et al.
2003/0197766 A1 10/2003 Barinaga et al.
2003/0202072 A1 10/2003 Childs et al.
2003/0202073 A1 10/2003 Dowell et al.
2004/0046807 A1 * 3/2004 Macler ..... B41J 2/1433 346/45
2005/0007427 A1 * 1/2005 Bellinger ..... B41J 2/17513 347/86
2005/0057619 A1 3/2005 Bybee et al.
2005/0073560 A1 4/2005 Gray et al.
2005/0110851 A1 5/2005 Smith et al.
2005/0122373 A1 * 6/2005 Katsu ..... B41J 2/16526 347/22
2005/0140749 A1 * 6/2005 Usui ..... B41J 2/17523 347/84
2005/0200655 A1 * 9/2005 Macler ..... B41J 2/1433 347/45
2005/0264626 A1 12/2005 Childs et al.
2006/0164473 A1 7/2006 Davis et al.
2006/0187281 A1 8/2006 Childs et al.
2006/0217457 A1 9/2006 Trueba et al.
2006/0238557 A1 10/2006 Studer et al.
2007/0052779 A1 * 3/2007 Cho ..... B41J 2/155 347/92
2007/0139454 A1 * 6/2007 Hamasaki ..... B41J 2/04541 347/12
2007/0139510 A1 * 6/2007 Hamasaki ..... B41J 2/2125 347/145
2007/0176980 A1 * 8/2007 Lim ..... B41J 2/055 347/70

FOREIGN PATENT DOCUMENTS

EP 1260372 A2 11/2002
JP 63054250 3/1988
TW 590899 2/1993

* cited by examiner

BUBBLER

CROSS-REFERENCE TO RELATED PATENT APPLICATIONS

The present application is a continuation application claiming priority under 35 USC section 120 from U.S. patent application Ser. No. 15/235,951 filed on Aug. 12, 2016 by Ozgur E. Yildirim et al. and entitled BUBBLER, which claimed priority from U.S. application Ser. No. 11/924,590 filed on Oct. 25, 2007 by Ozgur E. Yildirim et al. and entitled BUBBLER, which issued as U.S. Pat. No. 9,452,605 on Sep. 27, 2016, the full disclosures each of which are hereby incorporated by reference. The present application is related to U.S. patent application Ser. No. 11/111,127 filed on Apr. 20, 2005 by Anthony D. Studer, Kevin D. Almen and David M. Hagen and entitled METHODS AND APPARATUSES FOR USE AND INKJET PENS, the fill disclosure of which is hereby incorporated by reference.

BACKGROUND

During printing, ink or other fluid contained in a cartridge is ejected through one or more nozzles. Print quality may begin to degrade prior to complete cessation of transfer of ink to the paper in spite of some ink or fluid having been stranded in the cartridge.

DETAILED DESCRIPTION OF THE EXAMPLE EMBODIMENTS

Figure 1:
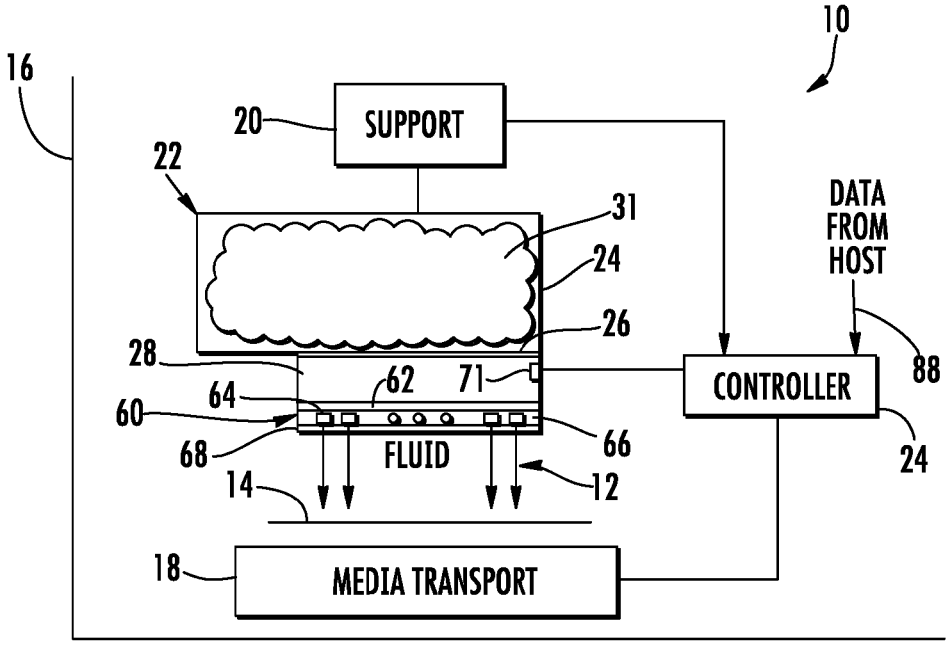
FIG. 1 is a schematic illustration of a fluid a deposition system including a cartridge according to an example embodiment.

FIG. 1 schematically illustrates fluid deposition system 10 configured to deposit a fluid 12, supplied by a cartridge 22, upon a medium 14. As will be described hereafter, cartridge 22 maintains print quality for a prolonged period of time even as the fluid within the cartridge approaches exhaustion.

Fluid 12 comprises a liquid material, such as ink, which creates an image upon medium 14. In other applications, fluid 12 may include or carry non-imaging materials, wherein system 10 is utilized to precisely and accurately distribute, proportion and locate materials along medium 14.

Medium 14 comprises a structure upon which fluid 12 is to be deposited. In one embodiment, medium 14 comprises a sheet or roll of cellulose-based or polymeric-based materials. In other applications, medium 14 may comprise other structures which are more 3-dimensional in shape and which are formed from one or more other materials.

Fluid deposition system 10 generally includes housing 16, media transport 18, support 20, cartridge 22 and controller 24. Media transport 18 comprises a device configured to move medium 14 relative to fluid ejection system 22. Transport 20 comprises one or more structures configured to support and position fluid ejection system 22 relative to media transport 18. In one embodiment, support 20 is configured to stationarily support cartridge 22 as media transport 18 moves medium 14. In such an embodiment, commonly referred to as a page-wide-array printer, cartridge 22 may substantially span a dimension of medium 14.

In another embodiment, support 22 is configured to move cartridge 22 relative to medium 14. For example, support 20 may include a carriage coupled to cartridge 22 and configured to move device 22 along a scan axis across medium 14 as medium 14 is moved by media transport 18. In particular applications, media transport 18 may be omitted wherein support 20 and cartridge 22 are configured to deposit fluid upon a majority of the surface of medium 14 without requiring movement of medium 14.

Cartridge 22 is configured to deposit fluid 12 upon medium 14. Cartridge 22 includes fluid reservoir 24, filter 26, standpipe 28 and print head 60. Fluid reservoir 24 comprises one or more structures configured to house and contain fluid 12 prior to fluid 12 being deposited upon medium 14 by ejection mechanism 30. In the embodiment illustrated, fluid reservoir 24 contains back pressure mechanism 31. Back pressure mechanism 31 comprises one or more structures configured to generate back pressure within chamber reservoir 24. In the example illustrated, back pressure mechanism 24 may comprise a capillary medium, such as foam, for exerting a capillary force on the printing fluid to reduce the likelihood of the printing fluid leaking. In other embodiments, other back pressure mechanism may be employed such as a spring bag, bellows or spring bag and bubble generator.

Filter 26 comprises one or more mechanisms configured to filter the printing fluid prior to the printing fluid entering standpipe 28. Filter 26 extends across and over standpipe 24 between standpipe 28 and reservoir 24. In one embodiment, filter 28 comprises a stainless steel filter screen material permanently staked onto standpipe 28. In other embodiments, filter 26 may comprise other materials and/or may be secured to or across standpipe 28 in other fashions.

Standpipe 28 comprises a fluid passage or conduit extending from filter 26 to print head 60. Standpipe 28 delivers fluid from reservoir 24 to print head 60. In addition, standpipe 28 also warehouses air or other gases that may be generated or that may enter print head 60 during printing.

Print head 60 comprises a mechanism configured to selectively deposit or apply fluid 12 supplied to it from reservoir 24 upon medium 14. Print head 60 is coupled to fluid reservoir 24 proximate to medium 14. For purposes of this disclosure, the term "coupled" shall the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. For purposes of this disclosure, the phrase "fluidly coupled" or in "fluid communication" means that two or more volumes are connected such that fluid may flow between such volumes. In one embodiment, ejection mechanism 30 is permanently fixed to reservoir 24. In another embodiment, print head 60 is releasably or removably coupled to reservoir 24.

Figure 2:
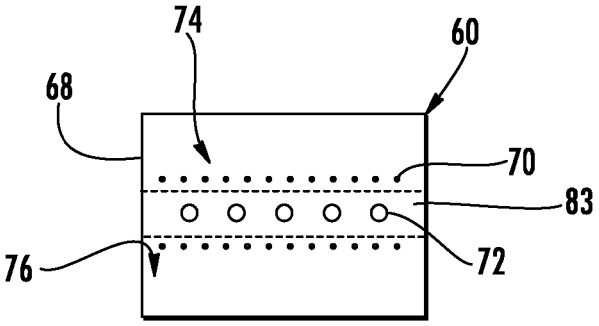
FIG. 2 is a bottom plan view of a print head of the cartridge of FIG. 1 according to an example embodiment.

Print head 60 includes die or substrate 62, fluid ejectors 64, barrier layer 66 and orifice plate 68 which includes nozzles 70 and bubblers 72 (shown in FIG. 2). Substrate 62 generally comprises a structure configured to support or serve as a base for the remaining elements of print head 60. Substrate 62 substantially extends between reservoir 24 and ejectors 64 and includes fluid feed slot 83 (shown in broken lines in FIG. 2) though which fluid flows from reservoir 24 to one or more of ejectors 64. In one embodiment, substrate 62 is formed from silicon. In other embodiments, substrate 62 may be formed from polymeric materials or other materials.

Fluid ejectors 64 generally comprise devices configured to eject fluid upon medium 14. Fluid ejectors 64 receive fluid from reservoir 24 through openings within substrate 62. Fluid ejectors 64 are carried by and formed upon substrate 62. Ejectors 64 selectively eject fluid through nozzles 70 and deposit fluid 12 upon medium 14 in response to control signals from controller 24. In one embodiment, fluid ejectors 64 may comprise thermal electric or thermoresistive drop-on-demand resisters, which in response to receiving an electrical current, heat and vaporize the fluid to expel remaining fluid through nozzles 70. In another embodiment, fluid ejectors may comprise piezo resistive fluid ejection device. In yet another embodiment, fluid ejectors 64 may comprise the electrostatic fluid ejection devices in which a diaphragm or flexible panel is moved in response to let for static forces to expel fluid through nozzles 70. In yet another embodiments, fluid ejectors 64 may comprise other devices configured to selectively eject fluid, such as ink, through nozzles 70.

Barrier layer 66 comprises one or more layers interposed between substrate 62 and orifice plate 36. Barrier layer 66 at least partially forms fluid firing chambers that are opposite nozzles 70 and adjacent to and about each of fluid ejectors 38. In one embodiment, barrier layer 66 may comprise a layer adhesively bonded on one side to substrate 62 and adhesively bonded on another side to orifice plate 68. In another embodiment, barrier layer 66 may itself comprise a layer of patterned adhesive between substrate 62 and orifice plate 68. In still other embodiments, barrier layer 66 may be integrally formed as part of a single unitary body or preformed as part of either substrate 62 or as part of orifice plate 36.

Orifice plate 68 comprises structure coupled to barrier layer 66 and substrate 62 so as to form a cap across and over the chambers formed by barrier layer 66 opposite to substrate 62 and fluid ejectors 64. As shown by FIG. 2, orifice plate 68 includes a multitude of apertures or openings which form nozzles 70 and bubblers 72. Nozzles 70 comprise openings through orifice plate 42 substantially opposite to fluid ejectors 64 through which droplets of fluid having a controlled size are expelled or ejected onto medium 14. In the example illustrated, nozzles 70 are arranged in two rows which selectively deliver the fluid from a single reservoir onto medium 14.

The diameter of nozzles 70 is such that with given the particular surface tension of the fluid or ink to be delivered from reservoir 24, any expected maximum back pressure within print head 60 or reservoir 24 as the fluid approaches near exhaustion will still be insufficient to overcome the surface tension of the particular fluid within reservoir 24 across the diameter of the opening of nozzle 40. In other words, the diameter of nozzles 70 are such that with the given particular surface tension of the fluid to be delivered from reservoir 24, air from outside will not be drawn into or bubble through nozzles 70 into the firing chambers of print head 60 or in to reservoir 24 during the life of cartridge 22.

In contrast to nozzles 70, bubblers 72 comprise openings through orifice plate 68 which are sized to permit air to be drawn through or bubble through such openings in response to increasing back pressures as the amount of fluid within reservoir 24 approaches exhaustion. By permitting air to be bubbled into the standpipe 28, bubblers 72 counteract the increase in back pressure to maintain print quality to a point in time closer to complete exhaustion of the ink or other printing fluid from cartridge 22.

Figure 3:
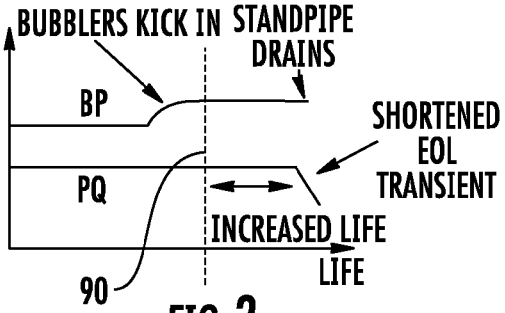
FIG. 3 is a graph illustrating print quality during the life of a cartridge of the system of FIG. 1 according to an example embodiment.

In particular, as shown by FIG. 3, back pressure (BP) within standpipe 28 or behind substrate 62 substantially stays the same or gradually increases over the life of cartridge 22 as fluid is extracted from reservoir 24. When fluid levels fall sufficiently low such that a partially saturated fluid band in mechanism 31 gets sufficiently close to filter 26 so as to begin to interact with filter 26, back pressure may begin to increase much more dramatically with further fluid or ink extraction. Without bubblers 72, such a dramatic increase in back pressure may cause a decrease in print quality (PQ) beginning at the time represented by the dashed line. From the time represented by the dashed line to the time when no fluid or ink is extractable from cartridge 22 is referred to as the "end of life (EOL) transient." During this transient, there appears to be usable ink or fluid within cartridge 22, but print quality may be poor. Although such print quality decreases, the disgruntled user may continue using the cartridge because he or she perceives that the cartridge is not yet empty. However, at the same time, if the user discards the cartridge, the user may feel that he or she is not obtaining full value from the cartridge by having to prematurely discard the cartridge.

As further shown by FIG. 3, bubblers 72 have a back pressure set point such that bubblers begin to bubble air and relieve back pressure just prior to or at time 90. As a result, a greater percentage of fluid within the standpipe is extracted and print quality is maintained for a prolonged period of time beyond time 90, providing cartridge 22 with an increased life. Once the fluid within the standpipe has been extracted, extremely little, if any, additional fluid is extracable from cartridge 22. As a result, the EOL transient is greatly shortened, providing the user with greater satisfaction.

However, as further shown by FIG. 3, bubblers 72 begin to bubble or permit air to be drawn through orifice plate 68 when the back pressure is rapidly changing near the end of the life of cartridge 22 but before the time at which the back pressure gets sufficiently high to cause a noticeable print quality defects. Bubblers 72 deprime standpipe 28 by replacing standpipe fluid with air through bubblers 72 such that fluid can continue to be extracted until almost complete exhaustion or complete exhaustion of fluid from standpipe 28. As a result, less ink is stranded in cartridge 22 upon its disposal leading to a longer useful life of cartridge 22 and facilitating recycling of cartridge 22 or disposal of a cleaner cartridge 22. Bubblers 72 further enable the use of thermal sensors 71 (schematically shown in FIG. 1) in standpipe 28 to detect the amount of fluid or ink within standpipe 28, wherein controller 24 may provide such information to users (such as with a low ink or ink out message on a display).

In one embodiment, bubblers 72 each have a circular cross-section with a diameter chosen based on the surface tension of the fluid being ejected and the desired backpressure set point. The back pressure set point is a backpressure threshold that when exceeded overcomes the surface tension of the fluid across the opening of the bubbler 72 such that air begins to bubble through bubblers 72. For example, to maintain the same back pressure set point while using a fluid with a greater surface tension, bubblers 72 will have a larger diameter. As will be described in greater detail hereafter with respect to the embodiment shown in FIG. 9, bubblers 72 may alternatively have elongated cross-sections such as being oval or rectangular, which enables bubblers 72 to be provided with reduced diameters. Bubblers 72 and nozzles 70 have diameters or opening dimensions such that nozzles 70 substantially inhibit or prevent air from being drawn through the openings of nozzles 70 during the life of cartridge 22, while at the same time, bubblers 72 have diameters or opening dimensions such that air is drawn through or bubbled across orifice plate 68 towards the end of the life of cartridge 22 (prior to complete exhaustion of the fluid within cartridge 22) at a desired back pressure set point (such as when back pressure begins to dramatically increase).

As further shown by FIG. 2, orifice plate 68 includes a plurality of bubblers 72 between rows 74 and 76 of nozzles 70. In other words, multiple bubblers 72 are provided for each fluid feed slot 83 across substrate 62 and for each standpipe 28. Because orifice plate 68 includes multiple bubblers 72 between consecutive nozzle rows 74 and 76, bubblers 72 (1) provide a sharper end of life experience, (2) are more robust and (3) reduce the noticeability of any impact of bubbling on print quality by distributing the bubbling events across multiple bubbler locations. First, because orifice plate 68 includes multiple bubblers 72 for an individual feed slot 83 or standpipe 28, bubblers 72 better dewet filter 28 by allowing more air to be introduced into standpipe 28 during each discharge of fluid through nozzles 70. As a result, such multiple bubblers 72 more effectively stabilize the dynamic back pressure as compared to a single bubbler 72 to better shorten the EOL transient and enhance user satisfaction.

Second, because orifice plate 68 includes multiple bubblers 72, the reliability and robustness of orifice plate 68 and bubblers 72 is increased. In particular, because orifice plate 68 includes multiple bubblers 72 for each fluid feed slot 83 of substrate 30 and for each standpipe 28, if one bubbler 72 becomes clogged by dried ink or a particle introduced from either the outside door from the inside, functionality is not lost altogether. Rather, the other bubblers 72 may continue to bubble air across orifice plate 68 to relieve or reduce back pressure increases which would otherwise potentially reduce print quality.

Third, because orifice plate 68 includes multiple bubblers 72 for an individual feed slot 83 or standpipe 28, the noticeability of any impact a bubblers 72 on print quality is reduced. In particular, in some circumstances, air introduced through bubblers 72 may sometimes block ink flow through nozzles 70 causing a print defect or "stutter". Because orifice plate 68 includes multiple bubblers 72, the introduction of air through bubblers 72 may be more random across the multiple nozzles 70 of rows 74 and 76. Because such stutter defects are more distributed and less uniform, such defects are also less noticeable.

Controller 24 generally comprises a processor configured to generate control signals which direct the operation of the media transport 18, support 20 and print head 60 of cartridge 22. For purposes of this disclosure, the term "processor unit" shall mean a conventionally known or future developed processing unit that executes sequences of instructions contained in a memory. Execution of sequences of instructions cause the processing unit to perform steps such as generating control signals. The instructions may be loaded in a random access memory (RAM) for execution by the processing unit from a read only memory (ROM), a mass storage device, or some other persistent storage or computer or processor readable media. In other embodiments, hardwired circuitry may be used in place of or in combination with software instructions to implement the functions described. Controller 24 is not limited to any specific combination of hardware circuitry and software, nor to any particular source for the instructions executed by the processing unit.

In operation, as indicated by arrow 88, controller 24 receives data signals representing an image or deposition pattern of fluid 12 to be formed on medium 14 from one or more sources. The source of such data may comprise a host system such as a computer or a portable memory reading device associated with system 10. Such data signals may be transmitted to controller 24 along infrared, optical, electric or by other communication modes. Based upon such data signals, controller 24 generates control signals that direct the movement of medium 14 by transport 18, that direct the positioning of cartridge 22 by support 20 (in those embodiments in which support 20 moves device 22) and that direct the timing at which drops fluid 12 are ejected by ejectors 64 of ejection mechanism 30. When the fluid within reservoir 24 falls so as to approach filter 26 such that back pressure dramatically increases, bubblers 72 begin to introduce air to counteract the increase in back pressure. As a result, print quality is maintained for a longer duration and to a point in time closer to complete exhaustion of fluid from cartridge 22.

Although cartridge 22 of system 10 is illustrated as including a single reservoir 24 and a print head 60 having a single fluid feed slot 83 supplying fluid to a pair or column of rows 74, 76 of nozzles 70, cartridge 22 may include a fluid feed slot supplying fluid to additional rows of nozzles 70. Although cartridge 22 is illustrated as having a single reservoir 24 and a single standpipe 28 providing fluid to two rows of nozzles 70, another embodiment, cartridge 22 may include a plurality of reservoirs 28 providing distinct fluids to distinct rows of nozzles 70 through distinct standpipes 28.

Figure 4:
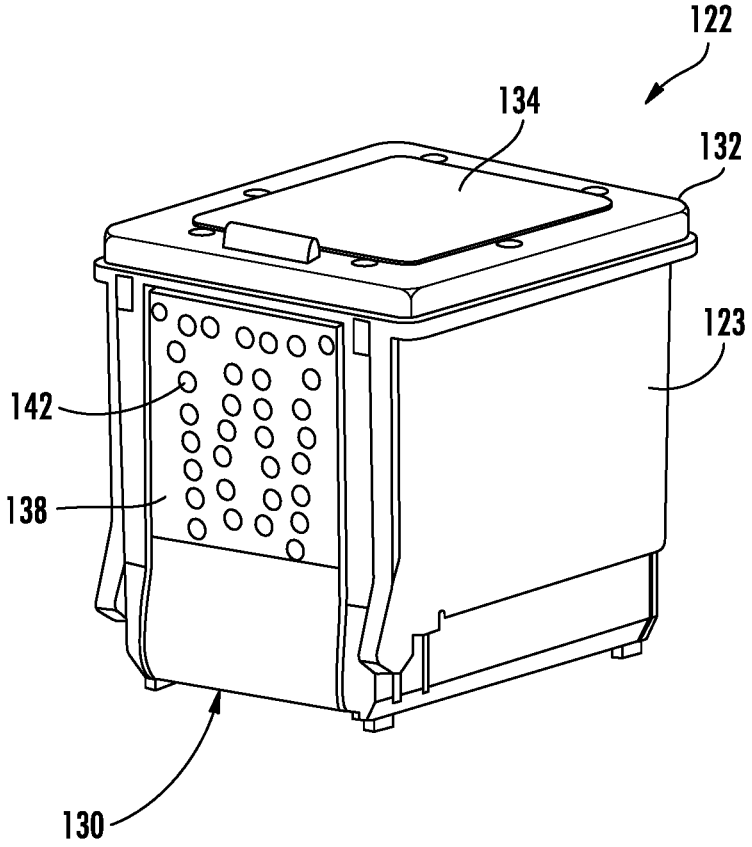
FIG. 4 is a top perspective view of another embodiment of the cartridge of FIG. 1 according to an example embodiment.
Figure 5:
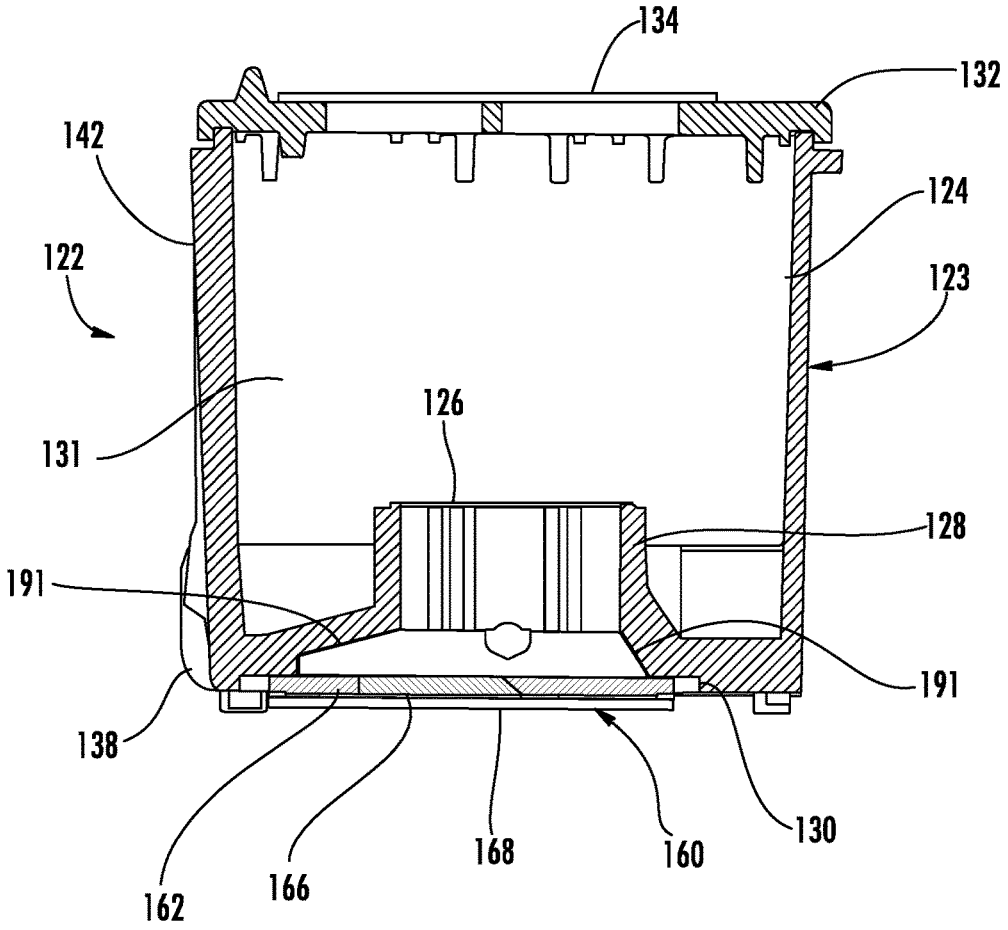
FIG. 5 is a sectional view of the cartridge according to an example embodiment.

FIGS. 4-8 illustrate print cartridge 122, another embodiment of print cartridge 22 shown in FIGS. 1 and 2. As shown by FIGS. 4 and 5, cartridge 122 includes body 123, cover assembly 125, filter 126, and print head assembly 130. Body 123 comprises a structure forming reservoir 124 and standpipe 128 (shown in FIG. 5). Fluid reservoir 128 comprises one or more structures configured to house and contain printing fluid. In the embodiment illustrated, fluid reservoir 124 contains back pressure mechanism 131. Back pressure mechanism 131 comprises one or more structures configured to generate back pressure within the chamber of reservoir 124. In the example illustrated, back pressure mechanism 131 comprises a capillary medium, such as foam, for exerting a capillary force on the printing fluid to reduce the likelihood of the printing fluid leaking. In other embodiments, other back pressure mechanism may be employed such as a spring bag, bellows or spring bag and bubble generator.

Standpipe 128 comprises a fluid passage or conduit extending between reservoir 128 and print head 130. Standpipe 128 delivers fluid from reservoir 124 to print head assembly 130. In addition, standpipe 128 also warehouses air or other gases that may be generated or that may enter print head assembly 130 during printing.

Lid assembly 125 includes lid 132 and cover 134. Lid 132 comprises a cap configured to contain printing fluid within reservoir 124. In example illustrated, lid 132 includes an arrangement or labyrinth of vent channels on its topside and a communication with its bottom side, permitting airflow into reservoir 124. Cover 134, also known as a vent label, is secured over lid 132 and covers portions of the vent channels. In other embodiments, lid 132 may omit such vents or may have other configurations. Cover 134 may also have other configurations or may be omitted.

Filter 126 comprises one or more mechanisms configured to filter the printing fluid prior to the printing fluid entering standpipe 128. Filter 126 extends across and over standpipe 128 between standpipe 128 and reservoir 124. In one embodiment, filter 126 comprises a stainless steel filter screen material permanently staked onto standpipe 128. In other embodiments, filter 126 may comprise other materials and/or may be secured to or across standpipe 128 in other fashions.

Print head assembly 130 comprises an assembly of components configured to selectively discharge or eject printing fluid onto a printing surface. In one embodiment, print head assembly 130 comprises a drop-on-demand inkjet head assembly. In one embodiment, print head assembly 130 comprises a thermoresistive head assembly. In other embodiments, print head assembly 130 may comprise other devices configured to selectively deliver or eject printing fluid onto a medium.

In the particular embodiment illustrated, print head assembly 130 comprises a tab head assembly (THA) which includes flexible circuit 138, encapsulate 140, electrical contacts 142 and print head 160. Flexible circuit 138 comprises a band, panel or other structure of flexible bendable material, such as one or more polymers, supporting or containing electrical lines, wires or traces that extend between contacts 142 and print head 160. Flexible circuit 138 supports print head 160 and contacts 142. As shown by FIG. 4, flexible circuit 138 wraps around body 123.

Encapsulates 140 comprise one or more material which encapsulate electrical interconnects that interconnect electrically conductive traces or lines of print head 160 with electrically conduct of lines or traces of flexible circuit 138 which are connected to electrical contacts 142. In other embodiments, encapsulates 146 may have other configurations or may be omitted.

Electrical contacts 142 extend generally orthogonal to print head 160 and comprise pads configured to make electrical contact with corresponding electrical contacts of the printing device in which cartridge 122 is employed.

Figure 6:
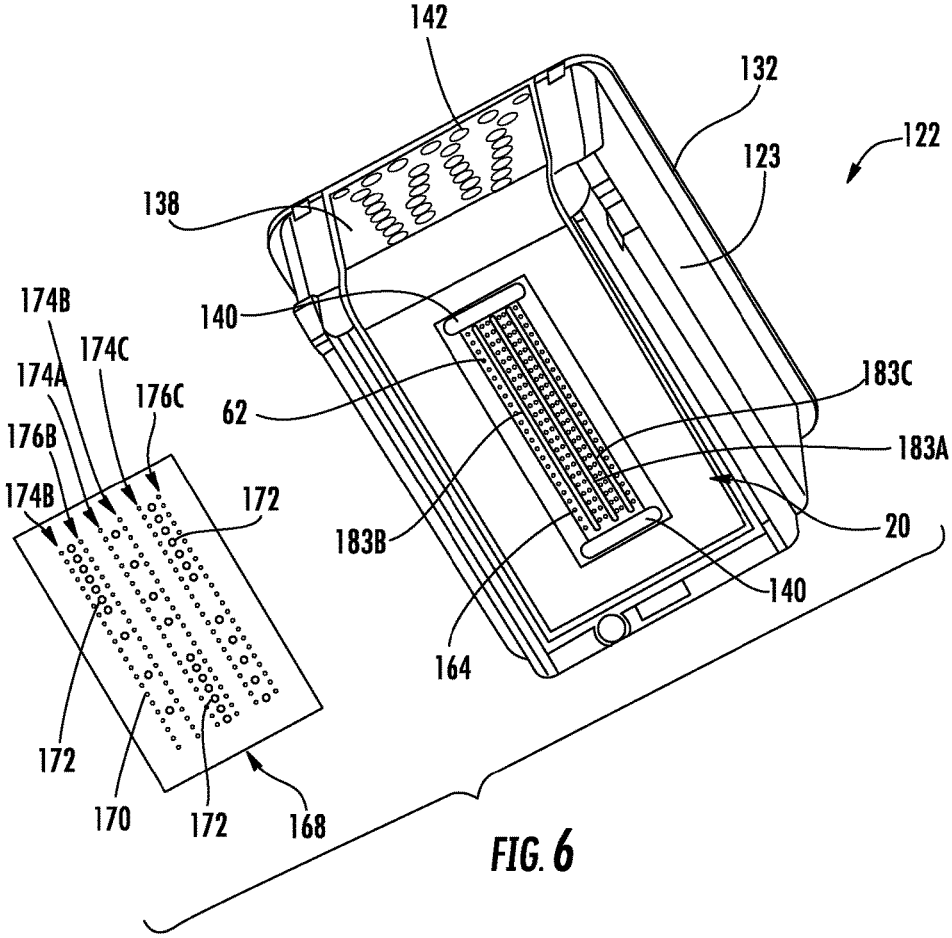
FIG. 6 is an exploded bottom perspective view of the cartridge of FIG. 4 according to an example embodiment.
Figure 7:
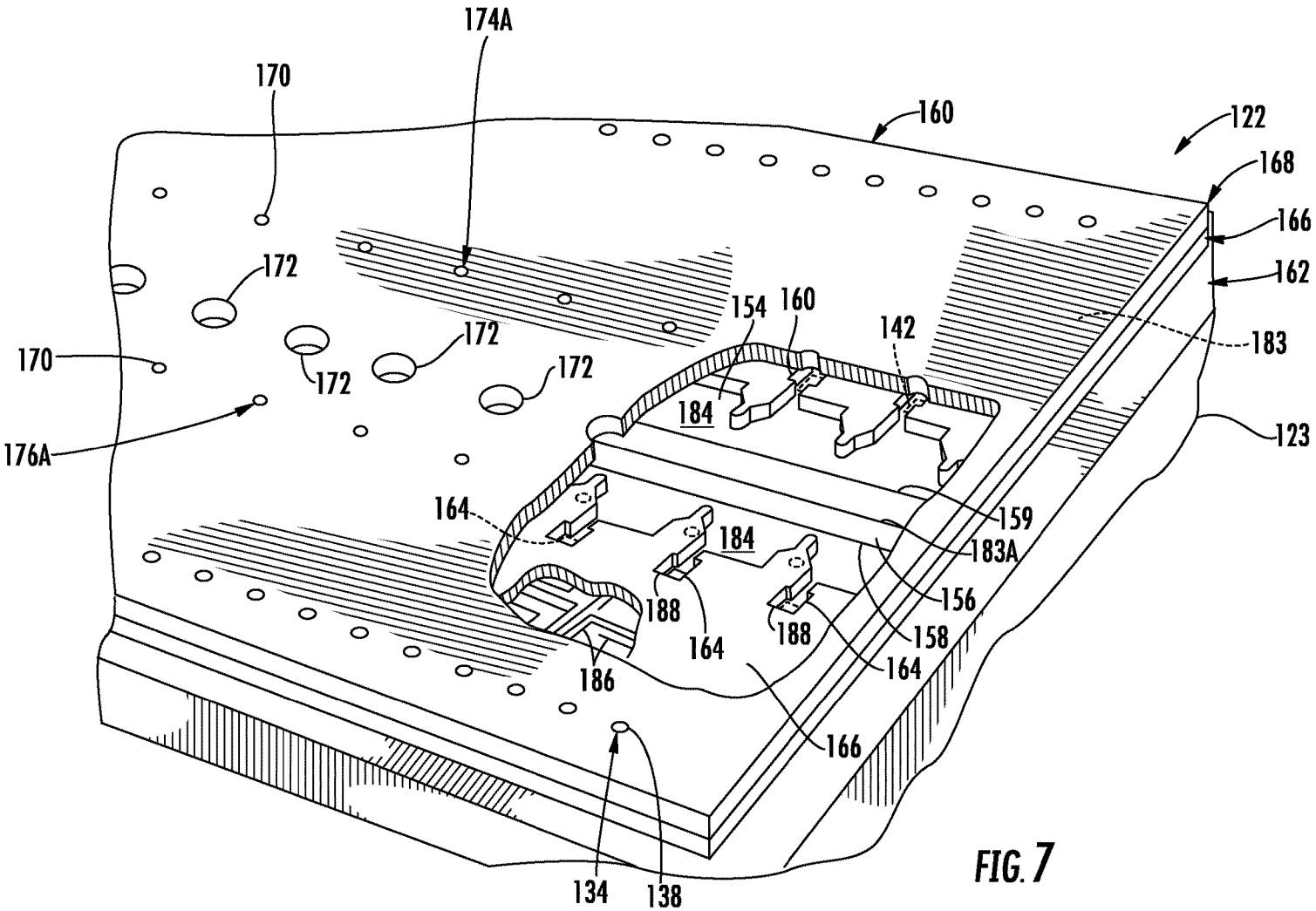
FIG. 7 is a fragmentary bottom perspective view of the cartridge of Figure numeral for according to an example embodiment.

Print head 160 is configured to selectively eject printing fluid based on signals received from contacts 142. As shown by FIGS. 6-7, print head 160 includes die or substrate 162, fluid ejectors 164, barrier layer 166 and orifice plate 168 which includes nozzles 170 and bubblers 172 (shown in FIG. 2). Substrate 162 generally comprises a structure configured to support or serve as a base for the remaining elements of print head 160. Substrate 162 substantially extends between stand pipe 126 and ejectors 164 and includes fluid feed slot 183 (shown in FIG. 7) though which fluid flows from reservoir 124, across shelves 184 to one or more of ejectors 164.

Fluid ejectors 164 generally comprise devices configured to eject fluid onto a medium. Fluid ejectors 164 receive fluid from reservoir 124 through feed slot 183. Fluid ejectors 164 are carried by and formed upon shelves 184 of substrate 162. Ejectors 164 selectively eject fluid through nozzles 170 in response to control signals transmitted from controller 24 (shown in FIG. 1) via electrically conductive traces, wiring or other firing circuitry 186 support on shelves 184 (shown in FIG. 7). In one embodiment, fluid ejectors 164 may comprise thermal electric or thermoresistive drop-on-demand resisters, which in response to receiving an electrical current, heat and vaporize the fluid to expel remaining fluid through nozzles 170. In another embodiment, fluid ejectors may comprise piezo resistive fluid ejection device. In yet another embodiment, fluid ejectors 164 may comprise the electrostatic fluid ejection devices in which a diaphragm or flexible panel is moved in response to let for static forces to expel fluid through nozzles 170. In yet another embodiment, fluid ejectors 164 may comprise other devices configured to selectively eject fluid, such as ink, through nozzles 170.

Barrier layer 166 comprises one or more layers interposed between substrate 162 and orifice plate 168. Barrier layer 166 at least partially forms firing chambers 188 adjacent to and about each of fluid ejectors 164. In one embodiment, barrier layer 166 may comprise a layer adhesively bonded on one side to substrate 162 and adhesively bonded on another side to orifice plate 168. In another embodiment, barrier layer 166 may comprise a layer of patterned adhesive between substrate 162 and orifice plate 168. In still other embodiments, barrier layer 166 may be integrally formed as part of a single unitary body or preformed as part of either substrate 162 or as part of orifice plate 168. Although barrier layer per 166 is disclosed as having the illustrated pattern in FIG. 7, another embodiment combat or layer 166 may have other patterns, arrangements or architectures.

Orifice plate 168 comprises structure coupled to barrier layer 166 and substrate 162 so as to form a cap across and over the chambers 188 formed by barrier layer 166 opposite to substrate 162 and fluid ejectors 164. As shown by FIGS. 6 and 7, orifice plate 168 includes a multitude of apertures or openings which form nozzles 170 and bubblers 172. Nozzles 170 comprise openings through orifice plate 168 substantially opposite to fluid ejectors 164 through which droplets of fluid having a controlled size are expelled ejected. As with nozzles 70 of print head 60 (shown in FIG. 2), the diameter of nozzles 170 is such that with given the particular surface tension of the fluid or ink to be delivered from reservoir 124 (shown in FIG. 5), any expected maximum back pressure within print standpipe 128 or reservoir 124 as the fluid approaches near exhaustion will still be insufficient to overcome the surface tension of the particular fluid within reservoir 124across the diameter of the opening of nozzle 170. In other words, the diameter of nozzles 170 are such that with the giver in particular surface tension of the fluid to be delivered from reservoir 124, air from outside will not be drawn into or bubble through nozzles 70 into the firing chambers of print head 60 or into reservoir 24 during the life of cartridge 122.

In contrast to nozzles 170, bubblers 172 comprise openings through orifice plate 168 which are sized to permit air to be drawn through or bubble through such openings in response to increasing back pressures as the amount of fluid within reservoir 124 approaches exhaustion. By permitting air to be bubbled into the standpipe 128, bubblers 172 counteract the increase in back pressure to maintain print quality to a point in time closer to complete exhaustion of the ink or other printing fluid from cartridge 122.

In particular, as shown by FIG. 3, back pressure within cartridge 122 substantially stays the same or gradually increases over the life of cartridge 122 as fluid is extracted from reservoir 124. When fluid levels fall sufficiently low such that a partially saturated fluid band in mechanism 131 gets sufficiently close to filter 126 so as to begin to interact with filter 126, back pressure may begin to increase much more dramatically with further fluid or ink extraction. Without bubblers 172, such a dramatic increase in back pressure may cause severe print quality defects even though the cartridge does not appear to be empty.

However, as further shown by FIG. 3, bubblers 172 begin to bubble or permit air to be drawn through orifice plate 168 when the back pressure is rapidly changing near the end of the life of cartridge 122 but before the time at which the back pressure gets sufficiently high to cause a noticeable print quality defects. Bubblers 172 deprime standpipe 128 by replacing standpipe fluid with air through bubblers 172 such that fluid can continue to be extracted until almost complete exhaustion or complete exhaustion of fluid from cartridge 122. As a result, the EOL transient is reduced. In addition, less ink is stranded in cartridge 122 upon its disposal leading to a longer useful life of cartridge 122 and facilitating recycling of cartridge 122 or disposal of a cleaner cartridge 122.

In one embodiment, bubblers 172 each have a circular cross-section with a diameter chosen based on the surface tension of the fluid being ejected and the desired backpressure set point. The back pressure set point is a backpressure threshold that when exceeded overcomes the surface tension of the fluid across the opening of the bubbler 172 such that air begins to bubble through bubblers 172. In other embodiments, bubblers 172 may have other shapes. For example, in another embodiment, bubblers 172 may be elongated such as being oval or rectangular, which enables bubblers 172 to be provided with reduced diameters. Bubblers 172 and nozzles 170 may have other diameters or opening dimensions such that nozzles 170 substantially inhibit or prevent air from being drawn through the openings of nozzles 170 during the life of cartridge 122, while at the same time, bubblers 172 have diameters or opening dimensions such that air is drawn through or bubbled across orifice plate 168 towards the end of the life of cartridge 122 (prior to complete exhaustion of the fluid within cartridge 22) when back pressure begins to dramatically increase.

Figure 8:
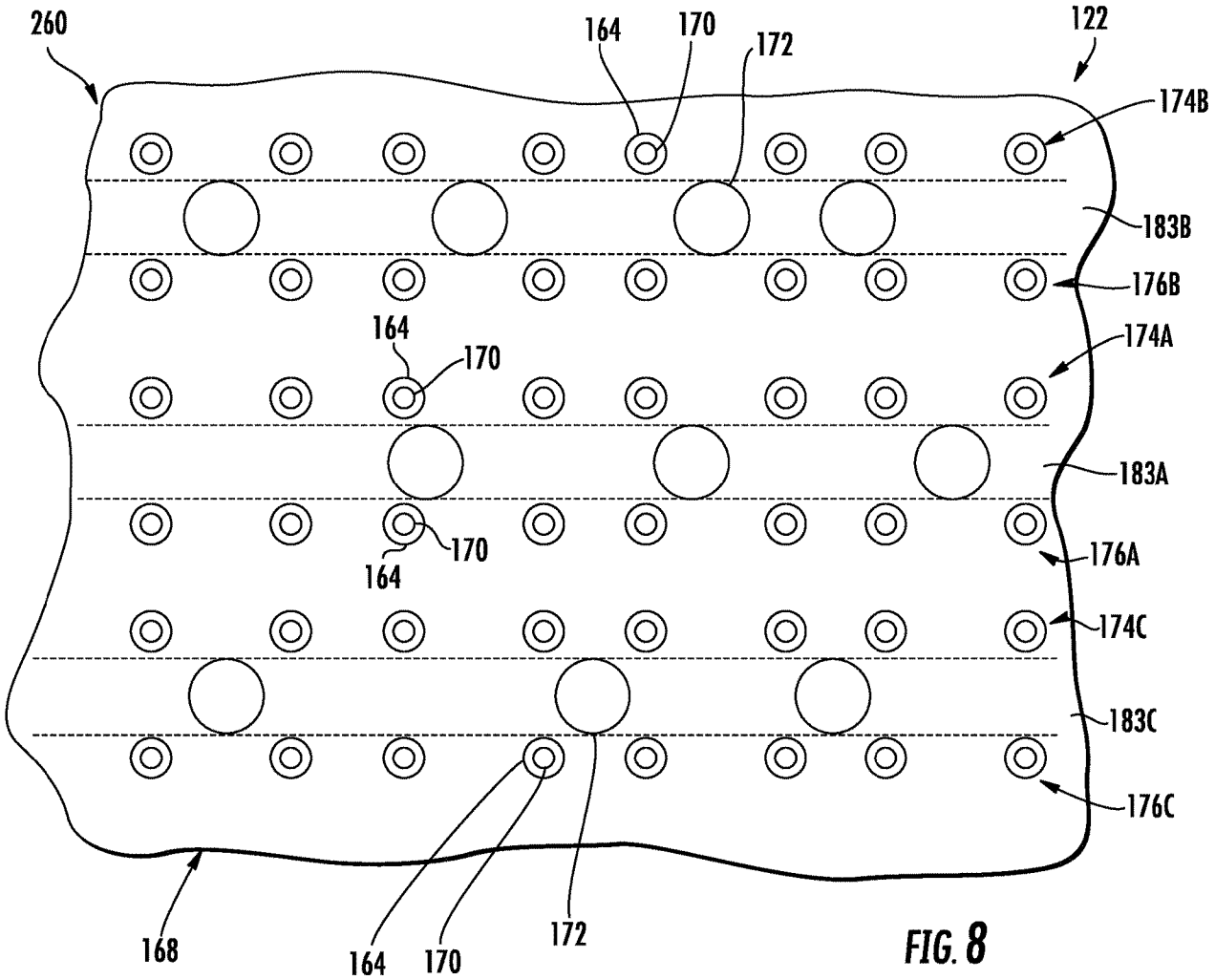
FIG. 8 is a fragmentary bottom plan view of the cartridge of FIG. 4 according to an example embodiment.

FIG. 8 is a bottom plan view of print head 130 illustrating includes fluid fill slots 183 in substrate 162 and further schematically illustrating fluid ejectors 164 with broken lines. As further shown by FIG. 8, orifice plate 68 includes rows 174A, 176A, rows 174B, 176B and rows 174C, 176C of nozzles 170. Each pair of rows 174A, 176A, rows 174B, 176B and rows 174C, 176C is fluidly coupled to and in fluid communication with a distinct one of reservoirs 124, a distinct associated feed pipe 126 and a distinct associated feed slot 183. As a result, each pair of rows 174A, 176A, rows 174B, 176B and rows 174C, 176C of nozzles 170 may deliver a distinct fluid. For example, in one embodiment, the distinct rows of nozzles 170 deliver distinct colors of ink, such as cyan, magenta and yellow colored inks. In another embodiment, other fluids may be delivered by the three pairs of rows of nozzles 170.

As further shown by FIG. 8, a plurality of bubblers 172 are provided between the nozzles 170 of each pair of rows. Multiple bubblers 172 are provided for each fluid feed slot 183A, 183B, 183C across substrate 162 and for each associated standpipe 128. In particular, bubblers 172 are located opposite to feed slots 183A, 183B, 183C. According to one embodiment, bubblers 172 are located directly opposite to standpipe 128 and filter 126 (shown in FIG. 5). As a result, incoming air passing through bubblers 172 is more likely to pass into standpipe 128 rather than becoming caught or becoming attached to other walls between standpipe 126 and substrate 162, such as walls 191 shown in FIG. 5.

Because orifice plate 168 includes multiple bubblers 172 between consecutive nozzle rows 174A, 176A, rows 174B, 176B and rows 174C, 176C, bubblers 172 (1) provide a sharper end of life experience, (2) are more robust and (3) reduce the noticeability of any impact of bubbling on print quality. First, because orifice plate 168 includes multiple bubblers 172 for an individual feed slot 183A, 183B, 183C or standpipe 128, bubblers 172 better dewet filter 128 by allowing more air to be introduced into standpipe 128 during each discharge of fluid through nozzles 170. As a result, such multiple bubblers 72 more effectively stabilize the dynamic back pressure as compared to a single bubbler 172 to permit a greater percentage of fluid can be used prior to printing defects being experienced.

Second, because orifice plate 168 includes multiple bubblers 172, the reliability and robustness of orifice plate 168 and bubblers 172 is increased. In particular, because orifice plate 168 includes multiple bubblers 172 for each fluid feed slot 183A, 183B, 183C of substrate 162 and for each standpipe 128, if one bubbler 712 becomes clogged by dried ink or a particle introduced from either the outside door from the inside, functionality is not lost altogether. Rather, the other bubblers 172 may continue to bubble air across orifice plate 168 to relieve or reduce back pressure increases which would otherwise potentially reduce print quality.

Third, because orifice plate 168 includes multiple bubblers 172 for an individual feed slot 183A, 183B, 183C or standpipe 128, the noticeability of any impact a bubblers 172 on print quality is reduced. In particular, in some circumstances, air introduced through bubblers 172 may sometimes block ink flow through nozzles 170 causing a print defect or "stutter". Because orifice plate 168 includes multiple bubblers 172, the introduction of air through bubblers 172 may be more random across the multiple nozzles 170 of rows 174A, 176A, rows 174B, 176B and rows 174C, 176C. Because such stutter defects are more distributed and less uniform, such defects are also less noticeable.

According to one embodiment, bubblers 172 have a non-uniform or varied pitch (the spacing or density of bubblers 172). In one embodiment, bubblers 172 have a smaller pitch (greater density) proximate to those nozzles 170 which are used less frequently. As a result, incoming air passing through such bubblers is less likely to interfere with our block the flow of the fluid or ink to the nearby nozzles 170.

According to one embodiment, and barrier layered over 166 has a thickness or height of between about 13 um and about 15 um, and nominally about 14 um. Fluid feed slots 183A-183C each have a width of between about 100 um and about 150 um. The fluid or ink is ejected through nozzles 170 and printed as a surface tension of between about 30 dyn/cm (color inks) and about 45 dyn/cm (black ink). Nozzles 170 each have a diameter of between about 7 μm to about 22 μm and a pitch of about 85 um (300 nozzles per cubic inch (npci)) or 42 um (600 npci). Bubblers 172 each have a diameter of about 20 to 40 μm (with the lower dimensions for color ink and the larger dimensions for black ink) and a pitch of about 300 μm. In other embodiments, such components may have other dimensions or values.

Figure 9:
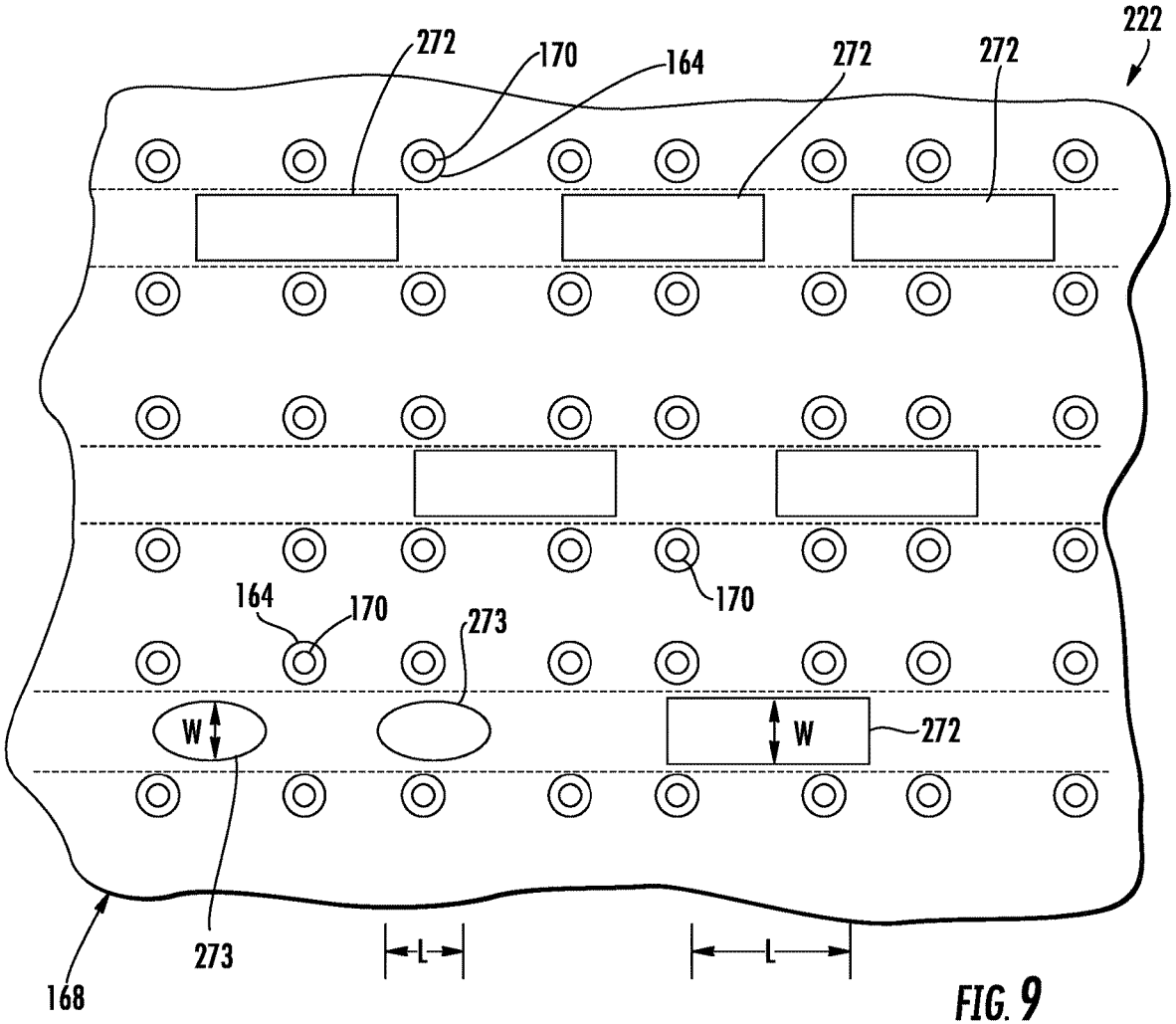
FIG. 9 is a fragmentary bottom bow and view of another embodiment of the cartridge of FIG. 8 according to an example embodiment.

FIG. 9 illustrates cartridge 222 and print head 260, another embodiment of cartridge 22 and print head 60.

Cartridge 222 is substantially identical to cartridge 122 except that cartridge 222 includes bubblers 272 and 273 in place of bubblers 172. All remaining elements of cartridge 222 are the same as those of cartridge 122 and are shown in described with respect to FIGS. 4-8. As shown by FIG. 9, in contrast to bubblers 172 which have circular cross-sections, bubblers 272 and 273 have elongated cross-sections. Bubblers 172 have rectangle cross-sections. Bubblers 273 have oval cross sections.

Because bubblers 272, 273 have elongated cross-sections, bubblers 272, 273: (1) may have smaller widths, (2) may have adjustable lengths without impacting the back pressure set point and (3) better block contaminants. First, because bubblers 272, 273 have elongated cross sections (a first dimension longer than a second orthogonal dimension), a given bubble pressure (the back pressure point at which air will pass through the bubbler for a fluid with a given surface tension) may be attained with a bubbler having a smaller width W as compared to be diameter of a bubbler having a circular cross-section. For example, the same bubble pressure may be achieved with a bubbler having a circular cross-section with a diameter 2 W can be achieved with a rectangular elongated bubbler with a width of slightly more than W provided the bubbler is much longer than it is wide (for example if L=10×W, then it takes a rectangular bubbler of width approximately 1.1 W to achieve the same bubble pressure as a circle with diameter 2 W). As a result, bubblers 272 and 273 may be provided with smaller widths as compared to the widths or diameters of bubblers 172 (shown in FIG. 8) while performing similarly. Because bubblers 272 273 may be narrower, bubblers 272 and 273 may be more easily located between pairs of rows of nozzles 170, increasing fabrication tolerances. Furthermore, such pairs or columns of rows of nozzles 170 may be more closely spaced, increasing nozzle density and opening up design space.

Second, the length L of bubblers 272, 273 may be varied or adjusted almost independently of W without substantially impacting the back pressure set point (i.e. the back pressure which air will begin to bubble through such bubblers). In particular, the formula for back pressure is BP=2*surface tension*(1/L+1/W). As a result, if L is much larger than W, then 1/W term dominates and changes in L only affect the outcome to a small extent. If one desires, as L is varied to large degrees, the exact BP set point can be kept the same by corresponding small adjustments in W to keep the (1/L+1/W) term the same. As a result, the length L may be adjusted to control or vary the rate at which air is bubbled through bubblers 272, 273 without substantially impacting the back pressure set point. For example, in lieu of having multiple bubblers 272 having a total collective length TL to achieve a desired total air flow rate through such bubblers 272, a single bubbler 272 having the same length TL may be used to achieve the same desired total air flow rate. Consequently, fabrication cost and complexity may be reduced. As noted above with respect to the benefits of providing multiple bubblers 72, increasing the total air flow rate may provide a sharper end of life experience by better maintaining fluid flow and print quality as the amount of fluid in the cartridge approaches exhaustion.

Third, because bubblers 272 and 273 may be provided with reduced widths W as compared to corresponding circular bubblers, bubblers 272 and 273 better impede or block the introduction of contaminants. The reduced width of bubblers 272 273 prevents contaminants or particles from passing through bubblers 272, 273 which would otherwise be able to pass through circular bubblers having a larger diameter. As a result, print heads including bubblers 272, 273 may be less subject to failures caused by the introduction of foreign contaminants which would otherwise potentially inhibit the bubbling of air, which would potentially migrate to and damage ejectors 164 or which would potentially migrate to and block otherwise healthy nozzles 170.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A cartridge comprising:

a fluid reservoir;

a print head to eject fluid from the reservoir through nozzles, the printhead comprising a fluid feed slot to supply fluid from the reservoir to the nozzles; and bubblers opposite the fluid feed slot.

2. The cartridge of claim 1, wherein the bubblers consist of a first bubbler opposite the fluid feed slot and a second bubbler opposite the fluid feed slot.

3. The cartridge of claim 1, wherein one or more of the bubblers have an elongated cross-section.

4. The cartridge of claim 3, wherein one or more of the bubblers have a length and a width, with the length at least 10 times the width.

5. The cartridge of claim 1, wherein the nozzles are arranged in a row with the nozzles of the row having a centerline-to-centerline pitch and wherein the bubblers comprises a bubbler adjacent the row of nozzles and having an elongated cross-section, the bubbler having a length greater than the centerline-to-centerline pitch of the row of nozzles.

6. The cartridge of claim 1, wherein the nozzles each have a diameter and wherein the bubblers comprises a bubbler having an elongated cross-section, the bubbler having a length and a width smaller than the length, the width being less than the diameter.

7. The cartridge of claim 1, wherein the print head comprises a resistor configured to contact and heat fluid from the reservoir so as to eject fluid from a reservoir through the nozzles.

8. The cartridge of claim 1 further comprising a plate, wherein the nozzles and the bubblers extend through the plate.

9. The cartridge of claim 1, wherein the nozzles and the bubblers are in a same plane.

10. The cartridge of claim 1, further comprising a foam-based back pressure regulator in the fluid reservoir.

11. The cartridge of claim 1, wherein the bubblers have a greater density proximate to those nozzles which are less frequently used.

12. The cartridge of claim 1, when the bubblers have non-uniform densities between the nozzles.

13. The cartridge of claim 1, wherein the nozzles have a diameter of between 15 micrometers and 25 μm and wherein the bubblers each have a smallest dimension of between 60 μm and 80 μm.

14. The cartridge of claim 1, wherein the nozzles have a diameter configured inhibit bubbling of outside air through the nozzles at a back pressure and wherein the bubblers have a dimension configured to permit bubbling of outside air through the bubblers at the back pressure.

15. A cartridge comprising:

a nozzle;

a fluid ejector to eject fluid through the nozzle;

a fluid feed slot to supply the fluid to the fluid ejector; and bubblers to bubble air into the fluid feed slot, the bubblers consisting of a first bubbler and a second bubbler.

16. The cartridge of claim 15 further comprising:

a second nozzle;

a second fluid ejector to eject fluid through the second nozzle;

a second fluid feed slot parallel to the fluid feed slot and to supply fluid to the second fluid ejector; and second bubblers to bubble air into the second fluid feed slot, the second bubblers consisting of a first bubbler and a second bubbler.

17. The cartridge of claim 15 further comprising a second fluid ejector to be supplied with fluid by the fluid feed slot.

18. The cartridge of claim 1, wherein one or more of the bubblers have an elongated cross-section.

19. The cartridge of claim 15 further comprising a nozzle plate having a nozzle through which the fluid ejector is to eject the fluid, wherein the first bubbler and the second bubbler each comprise an opening extending through the nozzle plate.

20. A cartridge comprising:

a fluid reservoir;

a first column of nozzles;

a second column of nozzles;

a first fluid feed slot to supply fluid for ejection through the first column of nozzles and the second column of nozzles;

a third column of nozzles;

a fourth column of nozzles;

a second fluid feed slot to supply fluid for ejection through the third column of nozzles and the second column of nozzles;

a first column of bubblers opposite the first fluid feed slot between the first column of nozzles and the second column of nozzles; and a second column of bubblers opposite the second fluid feed slot between the third column of nozzles and the fourth column of nozzles.

* * * * *